United States Patent [19]

Harrill

[11] 4,116,021

[45] Sep. 26, 1978

[54] HOSIERY HANDLING APPARATUS AND METHOD

[75] Inventor: John D. Harrill, Shelby, N.C.

[73] Assignee: Marvel Specialty Company, Hickory, N.C.

[21] Appl. No.: 827,269

[22] Filed: Aug. 19, 1977

[51] Int. Cl.[2] ..... D04B 15/88; D04B 27/34; D04B 35/00

[52] U.S. Cl. ..... 66/149 S; 66/147

[58] Field of Search ..... 66/149 R, 149 S, 148, 66/147; 223/43

[56] References Cited

U.S. PATENT DOCUMENTS

| | | | |
|---|---|---|---|
| 1,885,322 | 11/1932 | Bentley et al. | 66/150 X |
| 2,506,968 | 3/1950 | Oberholtzer | 66/150 X |
| 2,694,304 | 11/1954 | Butler | 66/147 |
| 3,159,015 | 12/1964 | Moretta | 66/149 S |
| 3,214,944 | 11/1965 | Kienel | 66/149 S |
| 3,273,360 | 9/1966 | Mahler | 66/149 S |
| 3,448,594 | 6/1969 | Macon | 66/149 R |
| 3,756,044 | 9/1973 | Grizzle | 66/147 |
| 3,779,046 | 12/1973 | Perkins | 66/147 |
| 3,887,120 | 6/1975 | Harrill | 223/43 |
| 3,949,913 | 4/1976 | Smith et al. | 223/43 |
| 4,047,649 | 9/1977 | Greogory | 223/43 |

FOREIGN PATENT DOCUMENTS

| | | | |
|---|---|---|---|
| 1,343,142 | 10/1963 | France | 66/149 S |
| 592,978 | 3/1959 | Italy | 66/149 |
| 957,507 | 5/1964 | United Kingdom | 66/149 |

*Primary Examiner*—Ronald Feldbaum

*Attorney, Agent, or Firm*—Lowe, King, Price & Becker

[57] ABSTRACT

An apparatus and method is provided for turning, separating, stacking and counting hosiery directly on a knitting machine. A hosiery positioning tube is suspended below the knitting cylinder of the machine with the hosiery string being knitted around the tube. The tube is suspended on a hanger extending through a hollow star rod of the machine. Intermittently driven feed rollers are positioned on opposite sides of the tube to step feed the hose string down the tube. Gripping fingers mounted on a swinging arm just below the bottom of the tube separate each hose in turn. An air orifice on the inner finger positioned in the mouth of tube intermittently blows the final hose on the string up into the tube to provide an everting operation. As the end of the turned hose approaches the mouth of the tube where a ring of Alginate yarn is knitted, the intermittent air pulses are interrupted and a continuous jet of air from an orifice adjacent the outer gripping finger blows the end of the hose inwardly and downwardly to position the end of the hose firmly in the grip of the fingers. The fingers close and the arm pulls the turned hose to separate it from the string and deliver it with the aid of another jet pulse of air across the edge of a stacking board. A stripper/pusher moves along the edge of the board to transfer the hose to a stack as still another air jet pulse blows the end of the hose free of the fingers. A counter may be provided to count the hose with switchable board means providing two collecting stations, each having a groove in which a string is positioned for tying one dozen pair in a bundle.

29 Claims, 10 Drawing Figures

V1
V2
V7
V6
V5
V4
V3
PRESSURE SOURCE
52
51
T
75
EXHAUST
50
65
66
64
62
94
93
36
35
23
34
LIFT
33
32
30
23
31
24
20
S
S2
40
R
22
21
42
41
1 SHOT TIMER
89
80
T5
T7
T6
T11
T4
72
70
74
S1
63
47
46
45
T3
T2
T10
T1
FROM PRESSURE SOURCE 52
COUNTER
EXHAUST
110
73
88
115
116
8
103
106
100
101
102
111
T2
T9
91
91
85
86
T8
92

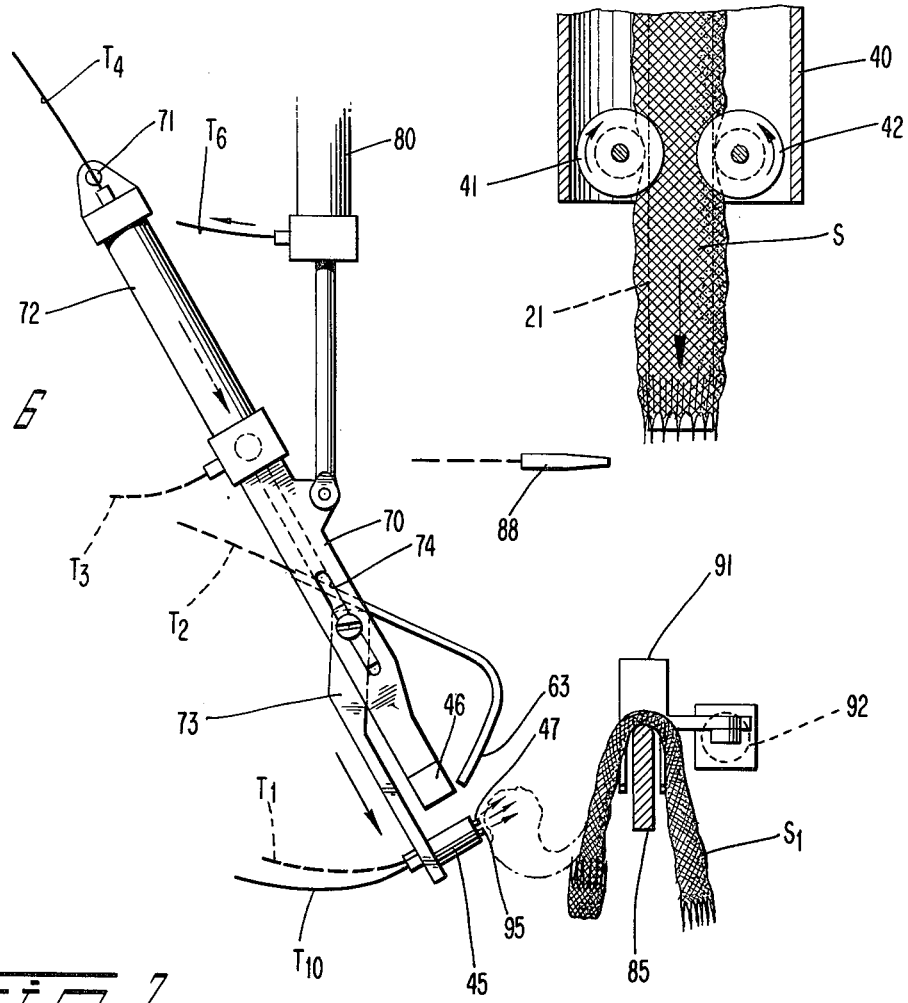
Fig. 6
Fig. 7
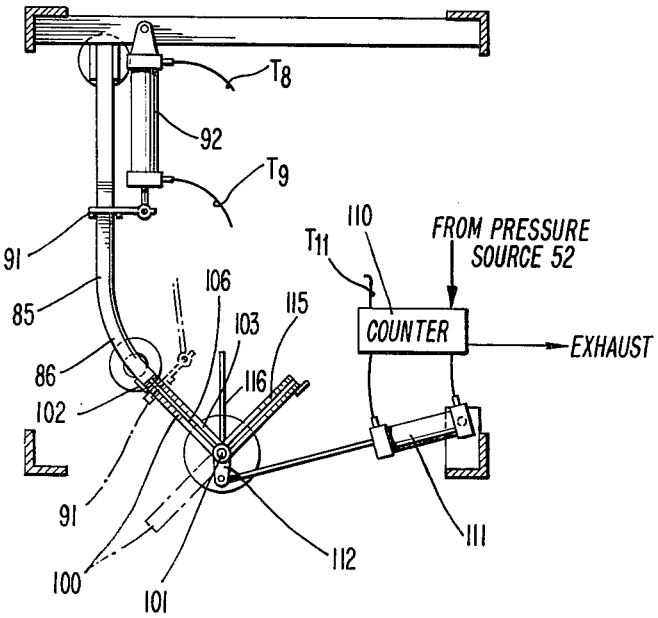
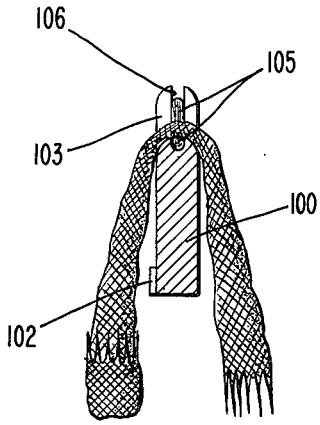
Fig. 8

HOSIERY HANDLING APPARATUS AND METHOD

FIELD OF THE INVENTION

The present invention relates to hosiery handling apparatus and method, and more particularly, to a system for everting, separating, stacking, counting and positioning for tying of hosiery on a machine knitting hosiery in a string.

BACKGROUND OF THE INVENTION

Hosiery for many years has been knitted in a string on Komet machines manufactured by Scott & Williams, Inc., of New York, New York. These machines have become a standard in the industry for knitting a wide range of hosiery for men, women and children. The hose are connected by a ring of Alginate yarn, which provides a break-away connection between the hose. This development has greatly increased the efficiency of the hosiery knitting operation.

To further process the hosiery, a "knitter" periodically removes the string of hose from the storage cannister on the machine, runs the string of hose on the forearm, grasps the final hose in the string and turns the hose. As the hose is turned, the "knitter" separates the hose by tearing the Alginate yarn ring. This operation presents the individual hose in an everted condition ready for sewing of the toe. This "hand operation" by actual motion and time studies has been shown to take approximately 60% of the knitter's time.

Various attempts over the years have been made to provide greater efficiency for handling the hose coming from the Komet knitting machine. The best "on machine" operation that has been accomplished prior to the present invention is a simple separation process accomplished by jerking the first in line hose away from the string, thereby breaking the Alginate ring. While these devices have worked, they have been generally unsuccessful in the knitting mills since the benefits gained did not justify the cost of the attachment, and maintenance problems have generally plagued such devices.

For the lack of something better, some mills have in the past opted for simply eliminating the turning operation by the knitter and perform what is known as a "turn-sew-turn" operation at the sewing station. This allows the knitter to handle a few more machines and thus does increase efficiency to some degree. The sewing machine operator performs the initial turning operation on a special turn-sew-turn machine thus providing a small net savings in terms of motion and time.

The most recent development has been the concept of turning, separating, stacking and tying of the hose on a separate machine. This development is represented in my previous United States Patent entitled "Hosiery Handling Method And Apparatus", U.S. Pat. No. 3,887,120, issued June 3, 1975. Improvements on my basic concepts are covered in U.S. Pat. No. 3,949,913, issued Apr. 13, 1976, entitled "Hosiery Handling Method And Apparatus", and copending application entitled "Apparatus For Handling Hosiery", Ser. No. 656,901, filed May 10, 1976, now U.S. Pat. No. 4,047,649 both issued to the same assignee as my inventions.

Up to the time of making my present invention, this was the most efficient machine and method providing the greatest net savings. This one machine performs the turning, separating, stacking and positioning for tying all in one very efficient operation.

As one will realize, this prior development does require the extra person to operate the machine. But all factors considered, the net gain over all of the old methods was substantial since a skilled operator can handle the output from a relatively large number of knitting machines, freeing the knitters to handle at least twice as many machines and thus eliminating the need for several knitters in a mill. In addition to requiring an operator for the machine, my previous machine also does require extra floor space in the mill.

Many experts have long contended that the maximum efficiency could be obtained by providing the turning, separating, counting, stacking and positioning for tying operations directly on the knitting machine. The reasons for this thinking are obvious since with such a handling method, the knitter simply ties the bundle and removes it directly from the knitting machine. The statistics available today show that this could increase knitter efficiency by 2 to 3 times, and therefore allow the knitter to handle upward of 60 machines. Under the old "hand" method where all of these operations were carried out manually, the operator could handle a maximum of 20 machines. Even over the improved methods that have come along including my previous machine and method, the efficiency is greatly improved, and of course, floor space for a separate machine is eliminated. Many, including myself, have long tried and failed to reach the goal of "on-the-machine" turning, separating, stacking and counting, and, insofar as I am aware, my invention is the first to achieve it.

OBJECTIVES OF THE INVENTION

Thus, one object of the present invention is to provide a hosiery handling apparatus and method wherein all operations between knitting and toe-closing are carried out directly on the knitting machine.

Another object of the present invention is to provide a handling apparatus and method wherein a string of hose from a Komet-type knitting machine is immediately everted, separated from the string, stacked in accurate alignment, positioned for tying, and counted, if desired.

Another object of the invention is to provide the hosiery handling system for performing the steps in the previous object, and in addition, automatically switching to an auxiliary collector as each 24 count is reached.

It is another object of the invention to provide an attachment for a Komet-type knitting machine wherein the machine may be easily converted without major modification to perform these additional essential handling steps, all without requiring additional floor space or in any way limiting access to the parts of the knitting machine for maintenance.

BRIEF DESCRIPTION OF THE INVENTION

In accordance with my invention, a knitting machine, such as the Komet machine manufactured by Scott & Williams, New York, New York, is fitted with a device for: (1) feeding a string of hose downwardly around a positioning tube suspended from above; (2) everting by air pulses the first-in-line hose on the string into the bottom of the tube; (3) move the hose with the toe end folded over free of the end of the tube by a second sustained jet pulse of air; (4) gripping the free end with a pair of fingers; (5) pulling and separating the hose from the string; (6) placing the hose over a stacking board in accurate aligned position with the aid of a third air pulse; (7) moving the hose to a collecting station while releasing the fingers with the aid of a fourth air pulse; (8) simultaneously counting each hose; and (9) positioning the stack of collected hose for easy tying. This manipulation of the hosiery string and separated hose eliminates manual handling of the hose and thereby greatly increases the efficiency of manufacture.

The positioning tube is supported in a unique manner by a support rod extending down through a hollowed out star rod. The suspension of the positioning tube in this manner allows the string of hose to be controlled and manipulated for turning. A rotating cylinder is positioned around the tube and carries opposed rollers that feed the string down the tube and keep the string in constant and proper tension. These feed rollers are stepped along by cam action as the cylinder rotates in the machine.

As each hose in the string approaches the mouth of the tube, intermittent pulses of air are provided at the end of the tube and by "jet effect" draw the sock into the tube to turn the hose on itself. The tube is provided with air escape apertures along its length in order to prevent trapping of the air in the tube and blowing the hose back out of the tube. The hose is held by friction in the tube in the turned condition, and as the toe of the hose approaches the end of the tube, the hose is ready to be separated.

The jet orifice for turning the hose is mounted on the inner one of the fingers forming the gripping means for separating the hose; i.e., the orifice is directed upward into the inside of the tube. Adjacent the outer finger there is provided the second orifice for releasing a timed continuous jet of air directed inwardly and downwardly to position the toe end of the hose firmly in the gripping fingers just before the separating operation is initiated.

Separation is accomplished by moving the arm away from the end of the tube, after the fingers have come together to grip the hose. As the hose is pulled away from the end of the tube, the Alginate yarn ring is broken just as was accomplished in my previous machines, and as is covered in my previous patents. The swinging arm throws the hose across a stacking board. This throwing operation is assisted by the third jet pulse, which also accurately pre-positions the hose over the board.

A pusher moves the hose up the stacking board toward a collecting station. During the initial movement, the fingers are still gripping the end of the hose. The near side of the hose is tensioned and the final accurately located position of all of the hose is assured by releasing the grip of the fingers. Since the apparatus of the invention is adapted to handle hosiery, including knitted tights, or other tubular knitted material, of any size up to about 80 inches, the amount draped on the sides of the board varies. For standard length men's hosiery, such as shown in the preferred embodiment, the hose is draped approximately one-half on one side and one-half on the other.

Timed with the opening of the fingers, a fourth pulse of air blows the toe end of the hose out of engagement with the fingers allowing the toe to fall free, as desired. The pusher continues to move along the board and deposit the hose at the collecting station. The pusher is operated by a pneumatic cylinder.

Optionally, a counter circuit can be employed to automatically limit the number of hose placed at one collecting station. An auxiliary collecting station, in the form of a switchable board, can be provided in order to alleviate the knitter from having to perform this operation.

The collecting stations are defined by separate collector boards mounted on a pivotal support. A pneumatic cylinder is controlled by the counter to switch to the open board after the required number of hose has been stacked.

The collector boards are advantageously provided with a groove to receive a cord so that the hose are stacked on top of the string and ready for tying as the knitter takes up the finished bundle. The collector board is curved to provide the desired shape to the bundle.

The entire operation is timed directly from the knitting machine. The various handling operations are advantageously performed either by jets of air or by air cylinders. This provides the advantage of use of a simple digital pneumatic circuit for control of the various operations at the proper time. The timing is performed in the preferred embodiment by stepped rotation of a timing drum with cams that operate the pneumatic micro-valves. The micro-valves may be provided in a modular assembly for easy accessibility and service.

Still other objects and advantages of the present invention will become readily apparent to those skilled in the art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

FIG. 6 is a detailed view showing the stripper plate starting to move up the stacking board and the hose being blown free of the gripping fingers;

FIG. 7 is a plan view showing the stacking and counting mechanism;

FIG. 8 is a cross-sectional view taken along line 8—8 of FIG. 2;

DETAILED DESCRIPTION OF A PREFERRED EMBODIMENT

Figure 1:
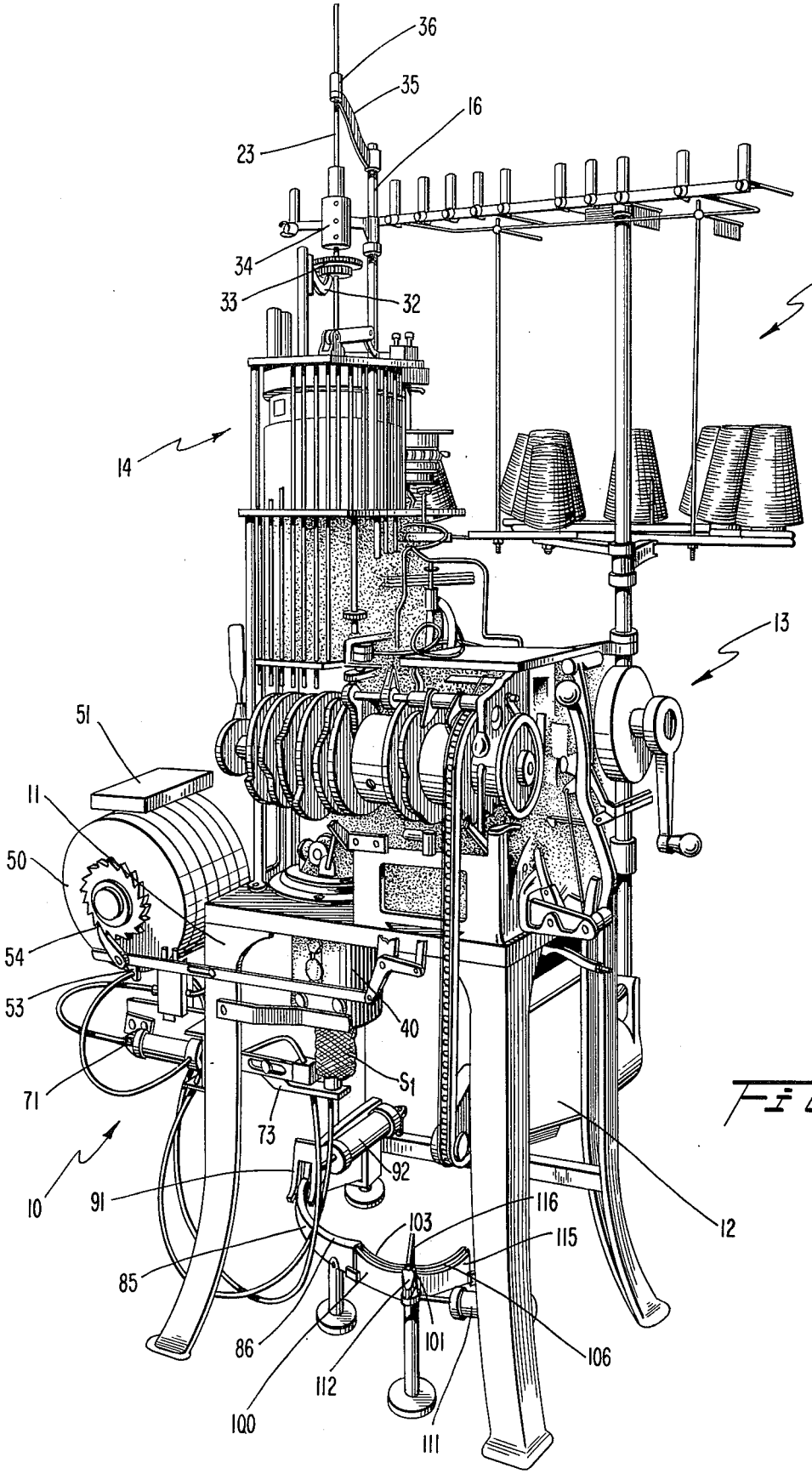
FIG. 1 is an overall perspective view of a Komet-type knitting machine with the hosiery handling attachment of the present invention mounted thereon.

A standard Komet-type knitting machine in FIG. 1 includes a hosiery handling mechanism 10, constructed in accordance with the principles of the present invention. This preferred embodiment is basically mounted on the base table 11 of the knitting machine. The machine also includes a main drive motor 12, a cam drive sub-assembly, generally designated by the reference numeral 13, a circular knitting head, generally designated by the reference numeral 14, and a yarn supporting section generally designated by the reference numeral 15. Above the knitting head 14 is a support tower 16 that in the standard machine serves to support and guide the star rod mounting a star disk to spread the heel and toe of the hosiery as it is being knitted. While it will be obvious that the handling device and method covered by the preferred embodiment shown in FIG. 1 has characteristics that uniquely adapt it to the field of hosiery manufacture, the invention will also be recognized to have application to the manufacture of other knitted articles that may be knitted in a string connected by rings of Alginate yarn on a circular knitting machine.

The hosiery handling mechanism 10 may be easily mounted directly on the knitting machine without major modification of the machine and without requiring significant additional floor space. Most of the mechanism is positioned below and to the immediate left of the base 11 of the Komet-type knitting machine. It should be recognized, however, that the particular location of the components of the apparatus on the knitting machine are not critical. The main objective here is to have the components adjacent or on the frame of the machine and as closely as possible within the confines of the original machine. Thus, variations in location of the parts can also be made without departing from the principles of the present invention.

Figure 2:
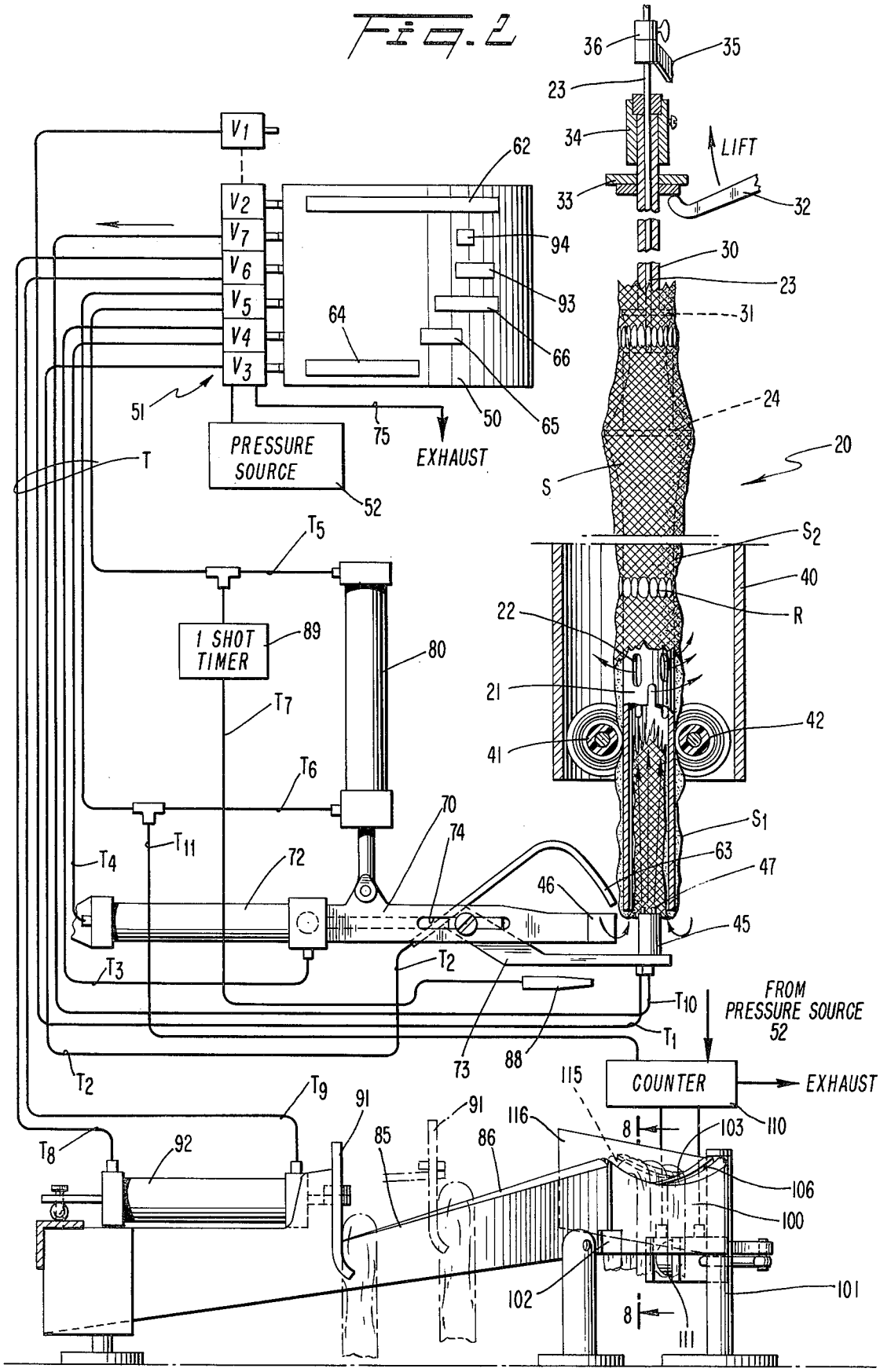
FIG. 2 is a schematic view of the essential components of the hosiery handling attachment and illustrating the pneumatic circuitry for operating the system, and with the everting operation of the hosiery string occurring at the positioning tube.

Referring to FIG. 2, schematically representative of the preferred system and method of the present invention, there is shown a positioning sub-assembly of the hosiery handling mechanism 10. A string S of knitted hosiery is coming from the machine beneath the table 11 (FIG. 1). Each of the hose $S_1, S_2 \ldots S_n$ are connected by an Alginate (or similar breakaway yarn) connector ring R, as described in my previous patents, mentioned above.

The positioning sub-assembly 20 includes a vertically extending positioning tube 21 having air egress slots 22 substantially along its full length thereof. The positioning tube is suspended from above on a support rod 22. Adjacent the top of the tube 21, a spreader ring may be provided to provide a controlled stretching of the tube as it comes from the knitting head 14.

The support rod 23 is uniquely mounted in a hollowed-out star rod 30 that carries at its lower end a star disk 31 for stretching the heel and toe portions of the hosiery as the knitting process takes place. A lift arm 32, standard on the Komet knitting machine, periodically lifts the hollow support rod 20 by engagement with the collar assembly 33. By this means, the star rod 30 slides along the inner support rod 23 and raises and lowers star disk 31, as required. A counter-weight assembly 34 is also fixedly attached to the hollow star rod 30 to assist in the action.

A fixed support arm 35 attached to the tower 16 suspends the positioning tube support rod 23 by a collar assembly 36 above said arm.

As the string S is knitted by the knitting head 14, it will be clear that it is thus positioned in an advantageous manner around the positioning tube 21. In accordance with the present invention, the string S can now be manufactured, and subsequently handled in a controlled fashion.

To keep the string S in a stretched or tensioned condition substantially along its length, a take-down cylinder 40 is provided in the machine where the collection canister on the standard machine is usually provided. This cylinder is rotated in timed sequence with the knitting operation just as the collection canister was previously rotated. The take-down rollers of the standard machine have been replaced by opposed take-down rollers 41, 42 (FIG. 2) on opposite sides of the tube 21. As will be seen later in detail, the rollers 41, 42 are concave and feed and tension the string S by frictionally engaging the opposite sides of the string S.

Just below the take-down rollers 41, 42, the hollow positioning tube 21 terminates and at this location, an important step in the handling method of the present invention takes place, i.e., the hosiery is turned or everted and then separated from the string S. To do this, a pair of gripping fringers 45, 46 are positioned adjacent this lower end and are adapted to grip one side of the first-in-line hose $S_1$ (refer to FIG. 4). One of the fingers, namely finger 45, is positioned so as to be directed straight up into the inside of the positioning tube 21. This finger is thus referred to as the inner finger 45 of the pair. The finger 46 is positioned adjacent the outside of the tube and is thus referred to as the outer finger 46.

A first air orifice 47 is positioned at the top of the inner finger 45 and provides a pulsing jet stream of air to the inside of the tube, as shown by the flow arrows in FIG. 2. The air thus entering the tube at the bottom may progress along the inside of the tube and then egress through the slots 22 (also see flow arrows in FIG. 2). The exit of the air prevents build-up of air pressure within the tube and allows a jet effect to be established adjacent the lower edge of the tube 21. This jet effect sucks the first-in-line hose $S_1$ into the tube, and thus performs the turning or everting operation on the hosiery. The jet effect is simply caused by a ring of low-pressure air that surrounds the pulsing jet issuing from the orifice 47. The low pressure is established by sucking ambient air into the high speed boundary layer of the pulsing jet, as is known broadly in the field of aerodynamics.

Before proceeding with a description of the additional apparatus and steps of the preferred embodiment, it would be helpful to first take a look at the digital pneumatic control system that controls the pulsing from orifice 47, as well as the other functions and steps. The control system includes a rotating timing drum 50 having a plurality of raised cams on its surface and a modular pneumatic micro-valve assembly 51 operated by the cams. The valves are provided with the high pressure air by pressure source 52. The pressurized air is fed to operating orifices, such as everting orifice 47 and others to be described below, through a series of feed tubes or lines, collectively designated by reference numeral T in FIG. 2.

This drum 50 is rotated in a stepped fashion by a reciprocating power link 53 operating directly from a cam in the drive sub-assembly 13 of the machine. The link 53 is drivingly coupled to the timing drum 50 by any suitable means, such as a simple ratchet mechanism 54. With this direct drive from the Komet machine, it will be recognized that each of the critical operations controlled by the micro-valves of assembly 51 are in perfect timed relationship to the knitting operation. There is thus no need for sensing the position of the hosiery string $S_1$ or any particular part of the string, at any time during the handling operation of the present invention. Also, the only outside source of energy is the air pressure provided by pressure source 52, which is readily available in the knitting mills. The elimination of electronic sensing devices and controls assures minimization of initial cost and later maintenance.

The turning or everting operation is controlled by pneumatic valve $V_1$ of the assembly 51. It will be recalled that the turning operation is accomplished by a pulsing air blast and continued throughout most of the knitting operation. The pulsing turns each first-in-line hose $S_1$, while the machine continues knitting the hose $S_n$.

Figure 9:
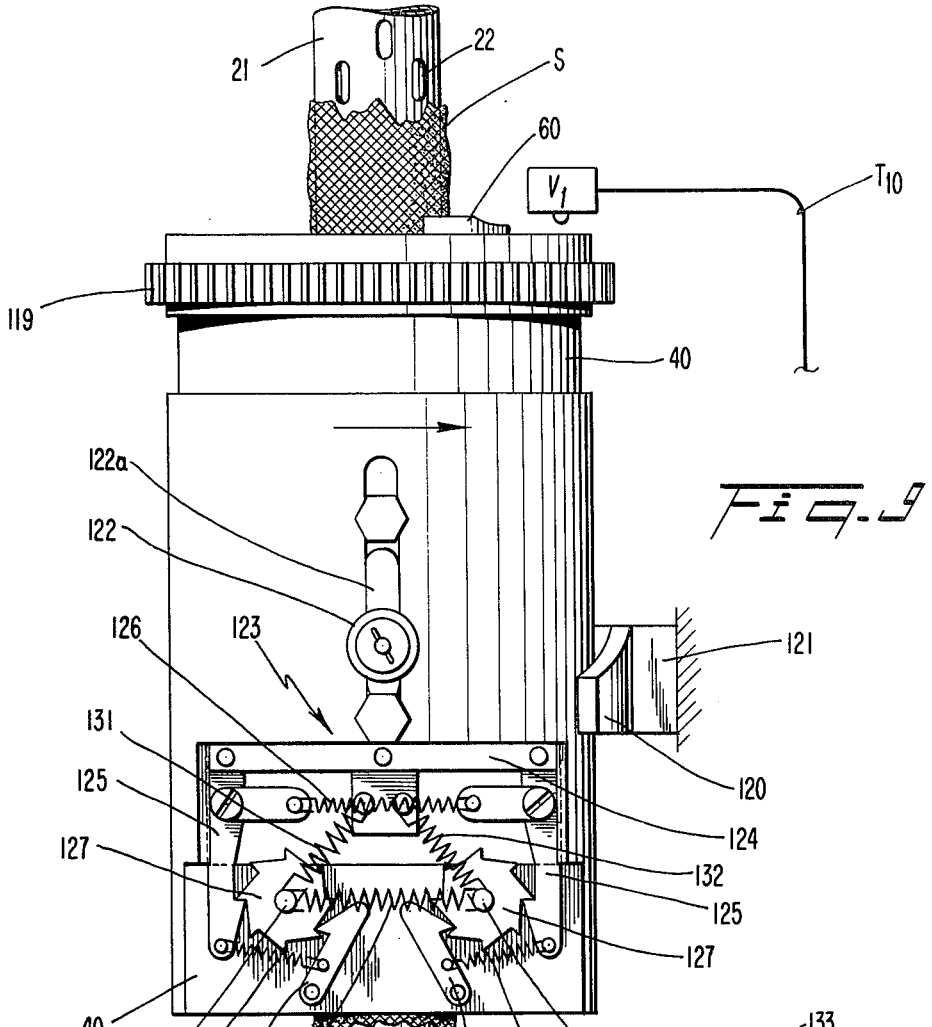
FIG. 9 is a front view of the take-down cylinder.

In order to provide the pulse, an operator cam 60 is mounted on the top of the take-down cylinder 40 (see FIG. 9). Thus, it will be realized that as the knitting head 14 and the take-down cylinder 40 make one revolution, one pulse of air is provided by the valve $V_1$. The air is transferred from the pressure source 52 to the orifice 47 through tube or line $T_1$, as shown in FIG. 2.

Operating in series with the turner valve $V_1$ is a turner lock out valve $V_2$. The valve is normally open, thus allowing the valve $V_1$ to provide pulses of air during most of the knitting cycle of the machine. However, during the period when each hose $S_1$ is being separated and stacked, a turner lock out cam 62 on the control drum interrupts the flow of air by engaging the valve $V_2$. This interruption occurs just before the toe end of the first-in-line hose $S_1$ (and the welt end of the next hose $S_2$) reaches the bottom of the positioning tube 21. The purpose of the interruption is to allow the toe end to be fed down free of the end of the tube 21 for grasping by the gripping fingers 45, 46, as will now be described.

Figure 3:
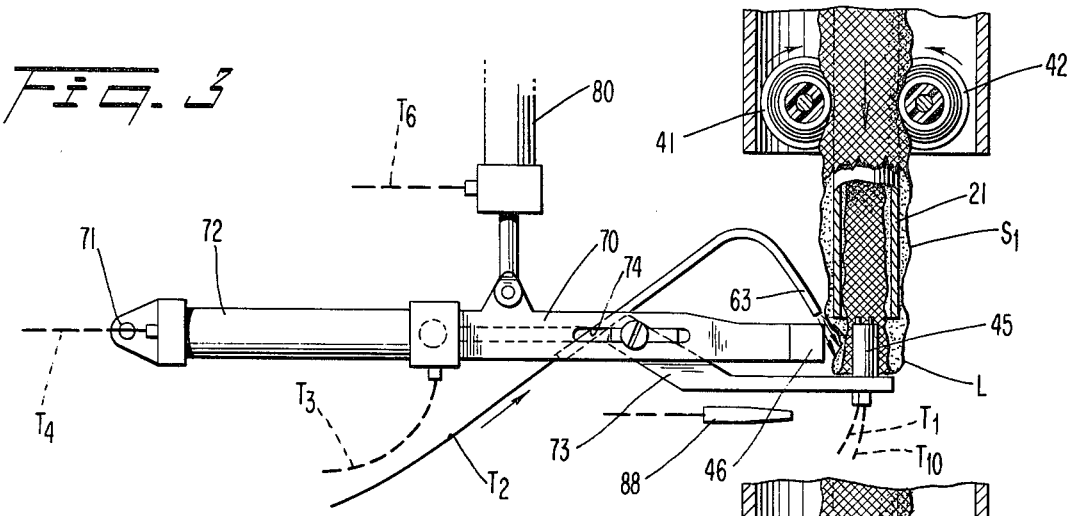
FIG. 3 is a detailed view of the next step of the method showing the turned-over toe end of the first-in-line hose being positioned for gripping.

Thus a second orifice 63 is mounted so as to be adjacent the outer finger 46 to direct a timed jet stream of air inwardly and downwardly, as shown in FIG. 3. This jet stream of air is controlled through the normally closed pneumatic micro-valve $V_3$ by cam 64. As can be seen in FIG. 2, the cam 64 on the rotating drum 50 becomes operative to engage the valve $V_3$ at the same time the turner interlock cam 62 is operative to terminate the pulsing through orifice 47.

In other words, as the turning operation stops, the continuous air stream as shown in FIG. 3 is started. As the machine continues to knit, an annular looped ring L is formed to feed a portion of the hose $S_1$ between the fingers 45, 46. The feed tube $T_2$ provides the air pressure from the source 52, as shown by the full line flow designation shown in FIG. 3. The continuous jet of air from the orifice 63 continues so long as the cam 64 (FIG. 2) engages the valve $V_3$. At the end of this time in each cycle, the next operation, namely, closing the fingers 45, 46, is ready to commence.

The closing of the fingers 45, 46 takes place when the next cam 65 on the face of the drum 50 comes into engagement with control valve $V_4$.

Figure 4:
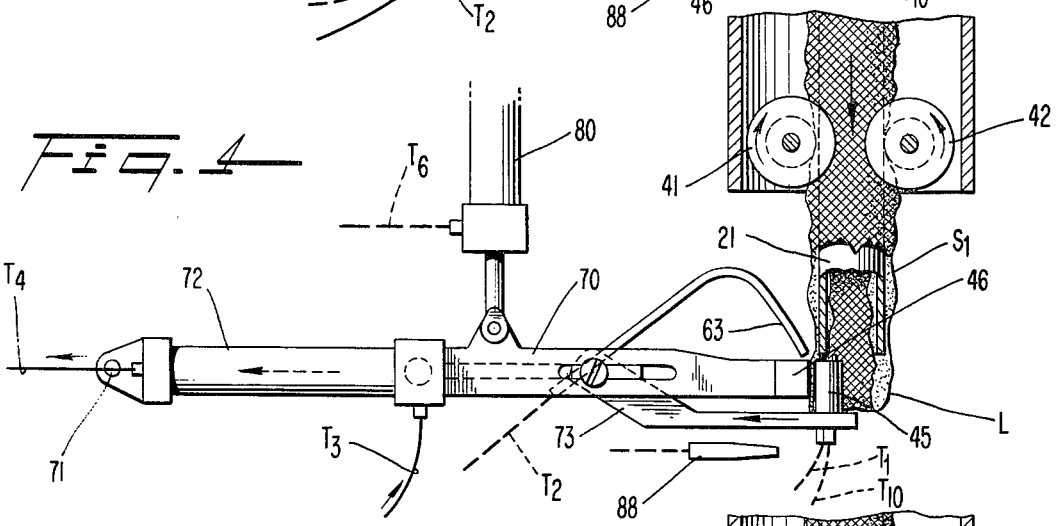
FIG. 4 is a detailed view showing the gripping fingers engaging the hose and commencing the separating operation.

The fingers are carried on a swinging arm 70 mounted about a rear pivot 71. The arm includes a first pneumatic cylinder 72 having a piston rod that operates a slide 73 along a slotted aperture 74. The slide 73 supports the inner finger 45 on its distal end. Dual valve $V_4$ is connected through two feed transfer lines $T_3$, $T_4$ to pneumatic cylinder 76 on the arm 70 to operate the slide 73. Cam 65 opens valve $V_4$ to shift the cylinder to close the gripping fingers 45, 46 in order to grip the looped ring L of the hose $S_1$, as shown in FIG. 4. Specifically, to close the fingers, line $T_3$ is pressurized by connection to pressure source 52, and simultaneously line $T_4$ is exhausted through exhaust port 75.

As can be seen by comparing the cams 64, 65 and noting absence of flow in line $T_4$ in FIG. 4, the jet of air from orifice 63 pulling the hose clear of the positioning tube 21 to form the looped ring L has been terminated simultaneously with the closing of the gripping fingers.

Mounted above the swinging arm 70 is a second pneumatic operating cylinder 80. This cylinder is controlled by the next valve $V_5$ responsive to cam 66 on the face of the control drum 50. As can be seen in FIG 2, dual valve $V_5$ is timed to operate shortly after the fingers 45, 46 have closed in response to the cam 65. Transfer air lines $T_5$, $T_6$ connect the cylinder 80 to the pressure source 52 and exhaust port 75, as will be clear from viewing FIG. 2.

Figure 5:
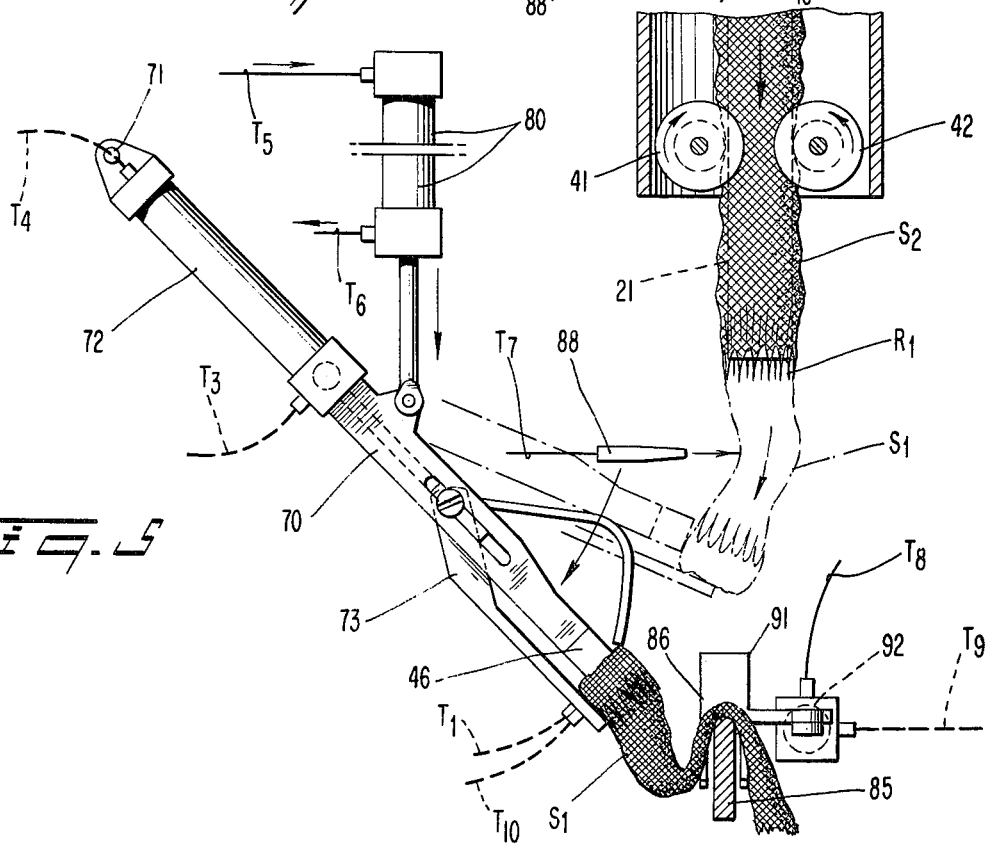
FIG. 5 is a detailed view of the next step, wherein the first-in-line hose has been separated and the hose is being directed across the stacking board.

As shown in FIG. 5, when cylinder 80 is activated by pressurization of line $T_4$ and simultaneous exhausting of line $T_5$, the arm 70 swings through an arc in the downward direction. Since the loop ring L has been firmly grasped by the fingers 45, 46, the connector ring $R_1$ adjacent the bottom of the tube is broken and the turned first-in-line hose $S_1$ is pulled from the interior of the positioning tube 21. The next-in-line hose $S_2$ on the string is held in position by the engagement of the take-down rollers 41, 42.

At this moment, the separating and turning operation of the method is complete. The operation is performed on the knitting machine itself unlike in the prior art where the operations are performed manually or on a separate machine. Furthermore, the separating and turning takes place concurrently with the continuous knitting by the machine. That is, there is no need to interrupt the continuous knitting operation at any point to carry out my method. Also, there is no major modification of the Komet machine required.

The next step to be performed is stacking. This is accomplished by taking each hose $S_1$, $S_2$ in-line as it is turned and separated, and draping the hose over a stacking board 85 (see FIGS. 2 and 5). The board has an inclined upper edge 86 where each of the hose is adapted to be held. Approximately one-half of the hose hangs on each side (FIG. 5) for standard length men's hosiery, as shown in this preferred embodiment. For shorter lengths, such as children's hosiery, more of the hose would be on the side adjacent the fingers 45, 46, and for the longer lengths, more would fall on the opposite side. For the longest lengths, a portion of the hosiery actually rests on the floor beneath the machine.

In order to assist the swining arm 70 in throwing the separated hose $S_1$ over the stacking board 85, a third air orifice is provided fixedly mounted on a portion of the frame of the machine below the positioning tube 21. A line $T_7$ is tapped into the line $T_5$ to supply this orifice. Thus, simultaneously with the downward movement of the arm 70, a stream of air is directed laterally against the hose. The stream of air ensures that the ungripped end (welt end) of the hose is thrown over the board 85 in a predictable fashion, as best illustrated in FIG. 5.

Since the stream is needed only during the time that the arm is moving along its downward arc, a simple one-shot timer 89 is interposed in the line $T_7$. Thus, each time the arm 70 swings downwardly, the orifice 88 emits a jet stream of air for a period of approximately equal to the swing time of the arm 70. The timer 89 then resets itself for the next cycle of the apparatus.

As soon as the hose $S_1$ comes to rest over the board 85, the next requirement is to push the hose up inclined edge 86 of the stacking board 85. A stripper/pusher plate 91 straddles the board 85 and is operated by pneumatic cylinder 92 fed through lines $T_8$, $T_9$. Dual pneumatic valve $V_6$ pressurizes and exhausts these lines through the next cam on the cylinder 50, namely cam 93. As can be noted by comparing cams 65 and 93 in FIG. 2, the timing is such that the plate 91 moves up the edge 86 (note dashed-lin outline) toward the collector station while the fingers 45, 46 are still gripping the toe end of the hose.

A short finite period after the stripper/pusher plate 91 has started up the inclined edge 86, the fingers are designed to open. At this point, the stripper/pusher plate 91 has assured that the sock $S_1$ is properly draped over edge 86, which condition is represented in FIG. 6 of the drawings. At this moment, cam 94 on the drum 50 actuates valve $V_7$ to pressurize line $T_{10}$ and blow through orifice 95, which positively ejects the gripped end from between fingers 45, 46. Orifice 95 is advantageously located immediately adjacent orifice 47 on the upper end of the finger 45.

The pusher plate 91 continues along the edge 86 to transfer each hose S to a collecting station at the end of the board 85. It will be remembered that the plate 91 is controlled by the cam 93, and when the end of this cam is reached (see FIG. 2) the plate 91 simply returns to its home position to await the next hose in line to be transferred. After this, the cam 66 finally terminates, thus shifting the air in transfer lines $T_5$, $T_6$ to reverse the cylinder 80 and bring the arm 70 back to its home position (FIG. 2). As the arm 70 is returned, the cam 62 terminates deactivating the turner lockout switch $S_2$, thus allowing the pulses of air from the orifice 47 to be reestablished and the turning of the next hose begins. With this, the cycle as described above is repeated.

The collecting station may take the form of a simple extension of the stacker board 85 where a number of hose can be held for pickup by the knitter. This collector board may have a concave upper edge in order to give form to the bundle as each hose is brought to the stack.

However, in the preferred embodiment of the present invention, the collecting station is also designed so as to perform an additional counting function, which can accurately count the hose and thus relieve the knitter of still another chore heretofore accomplished manually.

This preferred collecting and counting apparatus, as best shown by composite viewing of FIGS. 2, 7 and 8, comprises a first collector board 100 pivotally mounted on a suitable frame structure 101. The board 100 has a tab 102 providing alignment with the stacking board 85. As the pusher plate 91 reaches the top of the ramp along edge 86 (see FIG. 2), it continues across the small gap and onto the board 100 to position the hose one by one in a stack along concave upper edge 103.

The stacking board 85 may be straight or curved as shown. The curve is accommodated by the movement of the plate 91 by pivotal mounting of both the rear of the cylinder 92 and the point of attachment of the end of the piston rod and the plate. As shown in FIG. 7, the curve permits positioning of the stacking board 85 and the collecting apparatus within the outline of the knitting machine and places the stacked hose at a convenient location in the front for access by the knitter.

A cross-sectional view is shown in FIG. 8 to illustrate the manner in which a cord 105 may be positioned in a longitudinally extending recess 106 in the top edge 103 of the collector board 100. The cord is firmly positioned in the recess by the knitter after the previous bundle has been removed. As the bundle is picked up, the cord is in position for convenient tying.

A counter 110 is provided for the collecting apparatus. The counter should be stepped after each complete hosiery handling cycle has been completed. Since the last function to occur is the raising of the arm 70, a tap is made in line $T_6$ (FIG. 2) so that when the cylinder 80 is pressurized, a counting pulse will be received through line $T_{11}$. When the required count is registered, pressure from pressure source 52 operates a pneumatic cylinder 111 attached to arm 112 to swing the collector plate 100 about its pivotal mounting on the support 101. The swinging of the collector board 100 to the dotted line position of FIG. 7 positions the bundle or "dozen" of hosiery in the pick-up position for the knitter. The knitter simply ties the cord 105 around the hosiery and sends it immediately to the sewing machine operator for closing of the toe without the need for any other manipulation.

To provide the capability for the knitting machine to immediately commence handling the next bundle, or "dozen" of hosiery, I have provided an alternative collector board 115 mounted for movement with the operating level 112 and the board 100. The board 115 aligns with the end of the stacking board 85 when the board 100 is in the dotted line position. This provides the second collecting station.

Between the counter boards 110 and 115 is a divider 116 which serves the function of keeping the two bundles from becoming entangled.

When the alternative collector board 115 is filled, and assuming the knitter has previously removed the "dozen" from the board 100 and positioned the cord 105 in the slot 106, the board 100 switches back into the mating position with the stacking board 85 and the operation continues without interruption.

Figure 10:
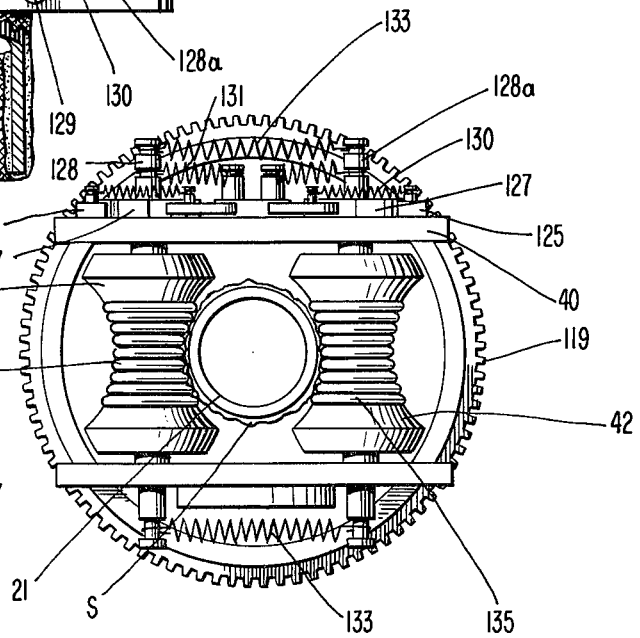
FIG. 10 is a bottom view looking up into the take-down cylinder showing the take-down rollers engaged with the hosiery on the positioning tube.

The structure of the take-down cylinder 40 is illustrated in FIGS. 9 and 10. A fixedly positioned cam 120 is mounted on a suitable bracket 121 held on the frame of the knitting machine. The cylinder 40 rotates in synchronization with the knitting head 14. The drive for the cylinder is through gear 119 (FIG. 9) from the drive sub-assembly 13 of the machine (see FIG. 1). A cam follower 122, mounted for vertical sliding movement on slide **122*a* on the side of the cylinder 40, engages the upper operative edge of the cam 120 during each revolution. Slide 122*a* is connected to a linkage assembly 123**.

The assembly 123 may include a cross-link 124 connected to the vertical slide **122*a* and to the top of two vertically extending actuating dogs 125. A tension spring 126 connected to short links holds the dogs 125 into engagement with the outer periphery of corresponding ratchet wheels 127. Ratchet wheels 127 are carried by shafts 128, 128*a* of the take-down rollers 41, 42, respectively. Locking dogs 129 prevent retro movement of the ratchets 127. The dogs are held in engagement with the ratchets 127 by tension springs 130, which also assist in stabilizing the lower end of the dogs 125. Tension springs 131, 132 effectively urge slide 122*a* downwardly so as to provide a bias against the lifting force of the cam 121 and return the slide 122a to the lower position upon each revolution. The rollers 41, 42 are urged into resilient engagement with the outer surface of the knitted string S by spring 133 on both sides of the cylinder 40 (FIG. 10**).

To improve the driving friction, the surface of the concave rollers 41, 42 may be provided with O-rings 135, sized to fit the girth of the rollers. The string S is in this manner kept under proper tension and properly fed down the positioning tube 21.

In summary, the apparatus and method of my present invention allows for the first time the turning of tubular knitted material, such as hosiery, directly on the knitting machine. The hosiery can not only be turned, but also separated in the same operation. The turning is advantageously performed by providing jet pulses of air through the air orifice 47 in the inner gripping finger 45 (see FIG. 2). Separation is accomplished by closing the fingers 45, 46 after the toe end of the hose reaches the bottom of the tube 21 and has been flown by orifice 63 down into a free loop ring L between the fingers. Once gripped, the hose is separated by downward swinging movement of the arm 70. A lateral pulse of air from orifice 88 ensures that the hose is thrown over a stacking board 85. A stripper/pusher 91 stacks the hose on switchable collection boards 100, 115 in response to a counter 110 to complete the operation.

In this disclosure, there is shown and described only the preferred embodiment of the invention, but, as aforementioned it is to be understood that the invention is capable of use in various other combinations and environments and is capable of changes or modifications within the scope of the inventive concept as expressed herein.

I claim:

1. In a circular knitting machine having a circular knitting head for knitting a depending string of tubular material, a positioning tube suspended in the machine below the circular knitting head about which the material is knitted and means for turning the material into lower the end of the tube during continuous the knitting operation.

2. The apparatus of claim 1 wherein is provided means for suspending said positioning tube, said suspending means being above the knitting head.

3. The apparatus of claim 2 wherein there is further provided a hollow star rod, and said suspending means including a rod extending down through the center of the hollow rod and connected to the positioning tube.

4. The apparatus of claim 1 wherein said means for turning the article includes air orifice means extending so as to provide a jet pulse of air up into the tube, supply means for providing air pressure to said orifice means, and means for releasing the air pressure from the inside of said tube, whereby to provide a jet effect entering the open end of the tube to turn said tubular knitted string.

5. The apparatus of claim 4 wherein said supply means for providing the jet pulse of air includes an intermittent operator to provide successive jet pulses of air.

6. The apparatus of claim 4 wherein it is further provided breakaway connector rings on said tubular knitted string forming in-line knitted articles, a pair of gripping fingers adjacent the open end of said positioning tube, means for closing said fingers to grip the end of the first in-line knitted article, and means for moving the fingers away from said tube to separate the article from the tubular string.

7. The apparatus of claim 6 wherein said air orifice means is positioned adjacent an inner finger of said pair directed upwardly in alignment with the open end of the positioning tube.

8. The apparatus of claim 7 wherein is further provided a second air orifice means adjacent an outer finger of said pair, said second orifice means being directed downwardly and inwardly to pull the end of said article free of said positioning tube and into the space between the gripping fingers.

9. The apparatus of claim 6 wherein it is further provided a stacking board below said positioning tube to catch the separated article removed by said fingers and direct said article to a collecting station for forming a stack of articles and third orifice means to flow the article over said board.

10. The apparatus of claim 9 wherein is further provided a fourth air orifice means adjacent said inner finger in alignment with said tube, said fourth orifice means serving to blow the gripped end of the article free of said fingers upon opening of said fingers.

11. The apparatus of claim 1 wherein is further provided a rotating take-down cylinder positioned around said tube, take-down rollers positioned on opposite sides of said tube in driving engagement with the tubular knitted string and means for driving said take-down rollers to provide constant tension on said tubular knitted string.

12. The apparatus of claim 11 wherein a further provided means on said take-down cylinder for actuating said rollers for tensioning said tubular string, and cam means for operating said actuating means on each rotation of said cylinder.

13. The apparatus of claim 11 wherein said means for turning the article includes air orifice means extending so as to provide a jet pulse of air up into the tube, supply means for providing air pressure to said orifice means, means for releasing the air pressure from the inside of said tube, whereby to provide a jet effect entering the open end of the tube to turn said tubular knitted string, and wherein is further provided cam means on said take-down cylinder to intermittently operate said supply means so as to provide air jet pulses to incremently evert said tubular material.

14. The apparatus of claim 11 wherein said take-down rollers have a concave driving surface mating with the side of said positioning tube, and O-rings extending around the girth of said rollers for gripping said tubular string.

15. The apparatus of claim 9, wherein said stacking board includes an inclined edge and pusher means for engaging each article to move the same to a collecting station.

16. The apparatus of claim 15, wherein said pusher means comprises a plate straddling the stacking board, said plate moving along said board to strip the article from the position where it is thrown over the board to move the same to a collecting station.

17. The apparatus of claim 16, wherein said collecting station includes a collector board aligned with said stacking board and receiving the articles moving along said edge.

18. The apparatus of claim 17, wherein said collector board is concave to form a stack of articles, the edge of said board including a recess to hold a cord for tying said articles into a bundle for further processing.

19. The apparatus of claim 17, wherein is further provided an additional collector board, means for mounting the collector boards for switching to mate with the stacking board in order to provide two collecting stations.

20. The apparatus of claim 19, wherein is provided counter means for determining the number of articles positioned on one of the collector boards, and switching means responsive to said counter means for automatically switching to the open collector board when the first collector board is full.

21. In a knitting machine for hosiery having a circular knitting head for continuously knitting a depending string of hose connected by rings of breakaway thread, a positioning tube suspended substantially vertically in the machine below the circular head about which the hose is knitted, means for everting the hose into the lower end of the tube during the knitting operation, and means for separating the hose from the string.

22. The apparatus of claim 21, wherein is further provided means for positioning the everted hose over the edge of a board and a stripper plate movable along the edge to push the hose to a collecting station where a stack is formed.

23. The apparatus of claim 22, wherein is provided orifice means extending up into the end of said positioning tube to provide jet pulses of air to perform the turning operation, second orifice means adjacent the end of the tube to provide a jet stream of air directed downwardly to move the end of the hose off the positioning tube, said separating means including gripping fingers, said first orifice means being adjacent the inner finger and said second orifice means being adjacent the outer finger.

24. The method of handling hosiery on a knitting machine comprising the steps of positioning a depending string of knitted hose on a tube suspended in the machine below the circular knitting head about which the material is knitted, and turning the material into the lower end of the tube during continuous the knitting operation.

25. The method of handling hosiery of claim 24 wherein is further provided the step of gripping the first-in-line hose on said string and separating the hose from the string in the everted condition.

26. The method of handling hosiery of claim 25, wherein the end of the hose is separated from the tube prior to gripping of the hose for separation.

27. The method of handling hosiery according to claim 26, wherein is further provided the step of throwing each hose by a jet pulse of air over the edge of a board, and moving each hose along the edge to a stack of hosiery.

28. In a circular knitting machine having a circular knitting head for knitting a string of tubular material, a positioning tube suspended in the machine below the circular knitting head about which the material is knitted, means for turning the material into the end of the tube during the knitting operation, breakaway connector rings on said tubular knitted string forming in-line knitted articles, a pair of gripping fingers adjacent the open end of said positioning tube, means for closing said fingers to grip the end of the first in-line knitted article, and means for moving the fingers away from said tube to separate the article from the tubular string.

29. The method of handling hosiery on a knitting machine comprising the steps of positioning a string of knitted hose on a tube suspended in the machine below the circular knitting head about which the material is knitted, turning the material into the end of the tube during the knitting operation, gripping the first in-line hose and said string and separating the hose from the string in the everted condition.

* * * * *